US009610787B2

(12) United States Patent
Kubota et al.

(10) Patent No.: US 9,610,787 B2
(45) Date of Patent: Apr. 4, 2017

(54) TAPE-LIKE MEMBER, TAPE CARTRIDGE, AND TAPE PRINTING DEVICE

(71) Applicant: Seiko Epson Corporation, Tokyo (JP)

(72) Inventors: Tomoyuki Kubota, Matsumoto (JP); Hideki Sakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/635,029

(22) Filed: Mar. 2, 2015

(65) Prior Publication Data

US 2015/0251464 A1 Sep. 10, 2015

(30) Foreign Application Priority Data

Mar. 5, 2014 (JP) ..... 2014-043094

(51) Int. Cl.

| | |
|---|---|
| ***B41J 15/04*** | (2006.01) |
| ***G09F 3/00*** | (2006.01) |
| ***B41J 3/407*** | (2006.01) |
| *G09F 3/02* | (2006.01) |

(52) U.S. Cl.

CPC ..... *B41J 15/044* (2013.01); *B41J 3/4075* (2013.01); *G09F 3/0295* (2013.01); *G09F 2003/0201* (2013.01); *G09F 2003/0247* (2013.01); *G09F 2003/0269* (2013.01); *Y10T 428/24793* (2015.01); *Y10T 428/24851* (2015.01)

(58) Field of Classification Search

CPC ..... Y10T 428/24777; Y10T 428/24793; Y10T 428/24802; Y10T 428/24851; Y10T 428/24868; B41M 5/508; G09F 3/02

See application file for complete search history.

(56) References Cited

U.S. PATENT DOCUMENTS

| | | | | |
|---|---|---|---|---|
| 5,382,055 A * | 1/1995 | Mertens | B42D 5/003 283/117 |
| 2007/0006963 A1* | 1/2007 | Bever | G09F 3/02 156/213 |
| 2013/0034678 A1* | 2/2013 | Yamamoto | G09F 21/02 428/41.8 |

FOREIGN PATENT DOCUMENTS

| | | |
|---|---|---|
| JP | 4695597 B | 6/2011 |
| WO | WO-2004-107294 A | 12/2004 |

* cited by examiner

*Primary Examiner* — Gerard Higgins

(74) *Attorney, Agent, or Firm* — ALG Intellectual Property, LLC

(57) ABSTRACT

A tape member having a length direction and a width direction includes: a folded tape main body that was formed by folding a tape main body in two along the length of the tape member, the folded tape main body having a print portion on a first side of a fold and a non-print portion on a second side of the fold, wherein the folded tape main body further includes an adhesive layer that pastes the print portion and the non-print portion together, and an outermost surface of the print portion forms a print surface and the adhesive layer is provided on an inner surface of the print portion that is opposite from the print surface.

10 Claims, 23 Drawing Sheets

TAPE-LIKE MEMBER, TAPE CARTRIDGE, AND TAPE PRINTING DEVICE

CROSS-REFERENCE TO RELATED APPLICATION

The entire disclosure of Japanese Patent Application No. 2014-043094, filed Mar. 5, 2014 is expressly incorporated by reference herein.

BACKGROUND

1. Technical Field

The present invention relates mainly to a tape-like member used for printing to prepare an identification label to be pasted on a cable or the like, and a tape cartridge and a tape printing device that are equipped with the tape-like member.

2. Related Art

According to the related art, as a tape-like member of this type, a tape that is suitable for a self-laminating label for identification of a wire and cable is known (see Japanese Patent No. 4695597).

This tape is formed by stacking a label material to have an image printed thereon and a liner material and folding the stacked materials into three parts in the shape of "Z". An adhesive material layer is formed on the back side of the label material, and the liner material is bonded to the adhesive material layer in an easily removable manner. The tape, thus formed, is wound into a coil, installed in a cassette system, and used for printing in a label printer. Then, the printed label has the liner material removed from the label material and pasted on a wire or cable.

The related-art tape as described above is folded in three in the shape of "Z" and therefore can be installed even in a cassette system (tape cartridge) having a limited maximum tape width. However, since the related-art tape has the structure in which the liner material is stacked on the label material, the liner material needs to be separated at the time of pasting the tape to a wire or cable. That is, there is a problem that the waste (trash) of the liner material is generated.

SUMMARY

An advantage of some aspects of the invention is to provide a tape-like member, a tape cartridge and a tape printing device that can achieve a narrow tape width and do not generate waste.

A tape-like member according to an aspect of the invention includes: a tape main body having a plurality of tape pieces folded on each other in a direction of width along a fold, and having a print surface formed on a surface situated on the outside of a tape piece situated in an outermost position; and an adhesive layer which pastes the tape pieces to each other. In the tape main body, when unfolded, the print surface is formed on one of a front side and a back side, and the adhesive layer is provided on the other.

In this case, it is preferable that the tape-like member further includes a release agent layer provided corresponding to the adhesive layer, on the neighboring tape pieces.

According to these configurations, since the plurality of tape pieces is folded in a superimposing manner in the direction of width, a narrow tape can be formed as a whole. Also, by performing desired printing on the print surface and then unfolding the plurality of tape pieces in such a way as to separate (strip off) the adhesive layer from the release agent layer, it is possible to forma sufficiently wide print label with respect to a pasting target. Thus, the print label can be pasted on the pasting target in a winding manner. Moreover, since the tape pieces are separably pasted to each other via the adhesive layer, no release tape (release sheet) is needed. Therefore, when the prepared print label is pasted onto the pasting target, the generation of waste (release tape) can be reduced.

A tape-like member according to another aspect of the invention includes: a tape main body having a print portion on one side and a non-print portion on the other side, the print portion and the non-print portion being folded in a direction of width along a fold and having a print surface on a surface situated on the outer side; and an adhesive layer provided on at least one surface situated on the inner side, of a surface situated on the inner side of the print portion and a surface situated on the inner side of the non-print portion, and having the other surface situated on the inner side pasted thereto.

In this case, it is preferable that the tape-like member further includes a release agent layer provided on the other surface situated on the inner side, corresponding to the adhesive layer.

According to these configurations, since the print portion and the non-print portion are folded in two in the direction of width, a narrow tape can be formed as a whole. Also, by performing desired printing on the print surface and then unfolding the print portion and the non-print portion in such a way as to separate (strip off) the adhesive layer from the release agent layer, it is possible to forma sufficiently wide print label with respect to a pasting target. Thus, the print label can be pasted on the pasting target in a winding manner. Moreover, since the print portion and the non-print portion are separably pasted to each other via the adhesive layer, no release tape (release sheet) is needed. Therefore, when the prepared print label is pasted onto the pasting target, the generation of waste (release tape) can be reduced.

It is preferable that the adhesive layer includes a first adhesive layer provided on the surface situated on the inner side of the print portion and having the surface situated on the inner side of the non-print portion pasted thereto, and a second adhesive layer provided on the surface situated on the inner side of the non-print portion and having the surface situated on the inner side of the print portion pasted thereto, and that the first adhesive layer and the second adhesive layer are arranged alternately in the direction of width.

In this case, it is preferable that the release agent layer includes a first release agent layer provided on the surface situated on the inner side of the non-print portion, corresponding to the first adhesive layer, and a second release agent layer provided on the surface situated on the inner side of the print portion, corresponding to the second adhesive layer.

According to these configurations, the first adhesive layer on the print portion has the function of pasting the non-print portion at the time of two-fold and also has the function of pasting the site of the print surface of the print label to the pasting target. Similarly, the non-print portion has the function of pasting the print portion at the time of two-fold and also has the function of pasting the non-print portion of the print label to the surface of the print portion. Also, if the non-print portion is made of a light-transmitting material, the non-print portion can be made to function as a laminate site that covers the print surface (where printed information and ground color can be seen). Meanwhile, if the first adhesive layer and the second adhesive layer are arranged at positions shifted from each other, releasability in the print portion and the non-print portion at the time of two-fold will not be impaired.

Also, it is preferable that an actual print area is provided on the print surface except both end parts in the direction of width, and that the first adhesive layer is provided on the surface situated on the inner side of the print portion corresponding to the actual print area.

According to this configuration, even when the first adhesive layer is provided on the inner side of the print portion, flatness of the actual print area can be maintained at the time of printing and deterioration in print quality can be prevented effectively.

Also, it is preferable that the second adhesive layer is provided at an end part of the surface situated on the inner side of the non-print portion that is opposite to the fold in the direction of width.

According to this configuration, when the print label is pasted onto the pasting target in a winding manner, the end part of the non-print portion that is the winding end part can be pasted properly and unwanted separation of the winding end part can be prevented.

Moreover, it is preferable that the print portion is formed to be wider than the non-print portion.

According to this configuration, when the print portion and the non-print portion in the two-fold state are separated from each other, the end part of the print portion can be made to function as a finger hook. Thus, the print portion and the non-print portion can be easily separated from each other.

It is also preferable that the fold is formed in the form of perforations.

According to this configuration, the print portion and the non-print portion can be easily folded in two, and protrusion of the fold part can be restrained. Thus, the fold part can be prevented from becoming excessively thick when the tape-like member is wound in a rolled shape.

A tape cartridge according to still another aspect of the invention includes: the tape-like member described above; a tape core on which the tape-like member is wound; and a cartridge case in which the tape-like member and the tape core are accommodated.

According to this configuration, the tape-like member, which becomes sufficiently wide when unfolded, can be accommodated in a narrow state in the cartridge case and can also be formed to be sufficiently thin, compared with the tape width of the tape-like member. Also, since the tape-like member needs no release tape (release sheet), the tape-like member having a sufficient length can be wound on the tape core and accommodated in the cartridge case, even though in the two-fold state.

In this case, it is preferable that a winding site where the fold side of the tape-like member is situated, of the tape core, is formed in a constricted shape with a circular arc-shaped cross section with respect to the other winding sites.

Similarly, it is preferable that a winding site where the fold side of the tape-like member is situated, of the tape core, is formed in a stepped form with a smaller diameter than the other winding sites.

According to these configurations, when the tape-like member is wound in a rolled shape on the tape core, the fold part of the tape-like member can be restrained from becoming excessively thick and a proper tape roll of the tape-like member can be formed.

It is preferable that the tape cartridge further includes a detection target part provided in the cartridge case and for detecting attribute information of the tape-like member.

According to this configuration, attribute information of a special tape-like member can be easily detected via the detection target part.

A tape printing device according to yet another aspect of the invention includes: a cartridge loading section where the tape cartridge described above is loaded removably; a detection part which is provided in the cartridge loading section, faces a detection target part, and acquires attribute information of the tape-like member; a print unit which prints on the tape-like member; and a print control unit which controls driving of the print unit on the basis of the attribute information acquired by the detection part.

According to this configuration, proper printing can be carried out on a special tape-like member on the basis of detected attribute information. The proper printing in this case (drive control of the print unit) includes high-density printing according to the purpose of use of the tape-like member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a tape-like member, a tape cartridge and a tape printing device according to an embodiment of the invention will be described with reference to the accompanying drawings. This tape-like member is a so-called print tape, and is installed in the tape cartridge in the state of being wound in a rolled shape, then loaded in the tape printing device and used for printing. In the tape printing device, after desired printing is carried out on the print tape, the printed part is cut to prepare a label. This label is pasted onto a plurality of cables or the like and used as an identification label for the individual cables or the like. Therefore, the print tape of this embodiment has a special configuration on the assumption of an identification label.

Print Tape of First Embodiment

Figure 1:
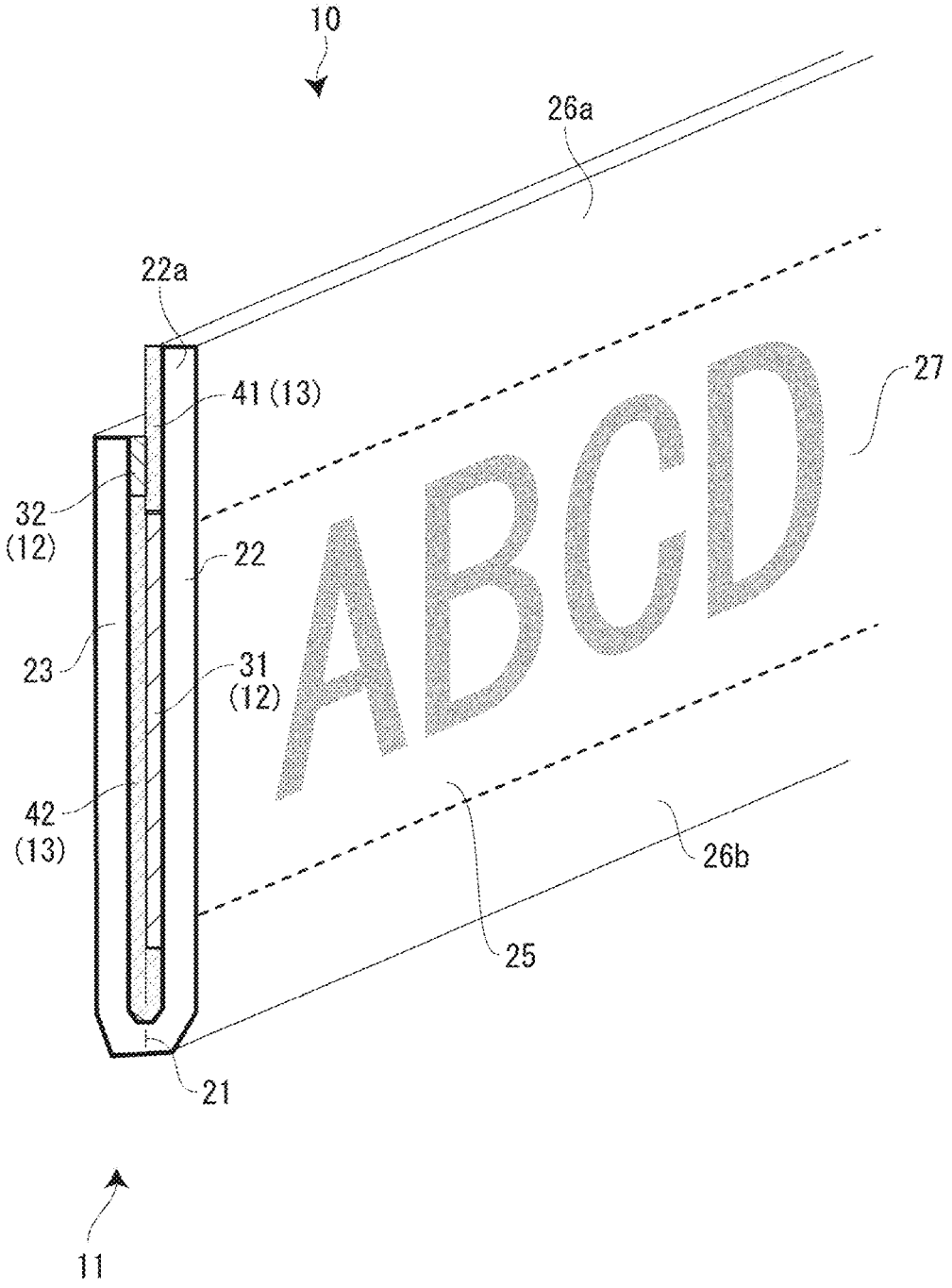
FIG. 1 is a perspective view of a print tape (tape-like member) according to a first embodiment.

FIG. 1 is a perspective view highlighting a cross-sectional configuration of a print tape (tape-like member) according to a first embodiment. As shown in FIG. 1, a print tape 10 includes a tape main body 11 folded in two in the direction of width, an adhesive layer 12 applied partly on the inner side of the tape main body 11, and a release agent layer 13 applied to the other parts than the adhesive layer 12, on the inner side of the tape main body 11.

The tape main body 11 forms the base member of the print tape 10 and has a print portion 22 on one side (right side in the illustration) and a non-print portion 23 on the other side (left side in the illustration), folded in two along a fold 21. The outer side (outer surface) of the print portion 22 is a print surface 25. On the print surface 25, an actual print area 27 with a predetermined width is set, reserving a top margin 26*a* and a bottom margin 26*b*.

The print portion 22 is formed to be wider than the non-print portion 23. That is, a width end part that is the end part in the direction of width of the print portion 22 protrudes with respect to the non-print portion 23, and this width end part forms a finger hook 22*a* used to strip off the print portion 22 and the non-print portion 23 from each other. Meanwhile, the fold 21 in this embodiment is formed in the form of perforations in order to achieve successful folding of the tape main body 11 and restrain this part from bulging.

The adhesive layer 12 includes a first adhesive layer 31 applied on the inner side of the print portion 22 and a second adhesive layer 32 applied on the inner side of the non-print portion 23. The first adhesive layer 31 is applied to the part corresponding to the actual print area 27 in such a way that the thickness of the layer does not affect printing. Meanwhile, the second adhesive layer 32 is applied to a width end part of the non-print portion 23. The second adhesive layer 32 and the first adhesive layer 31 are arranged alternately (at positions shifted from each other) in the direction of width.

As will be described in detail later, an identification label R prepared using the print tape 10 is pasted in a winding manner on a cable S that is a pasting target (see FIGS. 11A to 11D). In this case, the first adhesive layer 31 functions as a pasting start part that is directly pasted on the cable S, and the second adhesive layer 32 functions as a pasting end part that is pasted on the identification label R wound on the cable S. It is preferable that the print part (actual print area 27) of the print tape 10 is protected and visible. That is, it is preferable that a transparent tape is used in order to laminate the print part.

The release agent layer 13 is made of, for example, silicone or the like and includes a first release agent layer 41 applied on the inner side of the print portion 22 and a second release agent layer 42 applied on the inner side of the non-print portion 23. The first release agent layer 41 is applied to the other parts than the part where the first adhesive layer 31 is applied, on the inner side of the print portion 22. Specifically, the first release agent layer 41 is applied to the part corresponding to the top margin 26*a* and the part corresponding to the bottom margin 26*b*. Meanwhile, the second release agent layer 42 is applied to the other parts than the part where the second adhesive layer 32 is applied, on the inner side of the non-print portion 23.

Therefore, the first adhesive layer 31 is pasted on the second release agent layer 42 in an easily separable manner, whereas the second adhesive layer 32 is pasted on the first release agent layer 41 in an easily separable manner. Thus, the tape main body 11 maintains the two-fold configuration and the print portion 22 and the non-print portion 23 are configured in the way that allows these pieces to be stripped off from each other. Also, the second release agent layer 42 may be provided only at the part corresponding to the first adhesive layer 31, and the first release agent layer 41 may be provided only at the part corresponding to the second adhesive layer 32.

Print Tapes of Modifications of First Embodiment

Next, the print tapes 10 according to modifications of the first embodiment will be described with reference to FIGS. 2A to 2I. In the modifications below, different parts from the first embodiment will be mainly described.

Figure 2A:
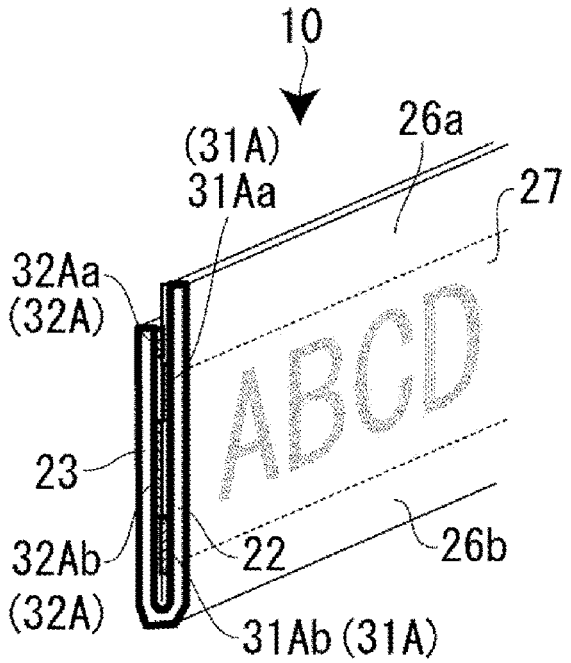
FIG. 2A is a perspective view of a first modification of the print tape according to the first embodiment.

In a first modification shown in FIG. 2A, a first adhesive layer 31A of the print portion 22 includes a top first adhesive layer 31Aa applied to the part corresponding to the top end part of the actual print area 27 and a bottom first adhesive layer 31Ab applied to the part corresponding to the bottom end part of the actual print area 27. Also, a second adhesive layer 32A of the non-print portion 23 includes a top second adhesive layer 32Aa applied to the width end part and a middle second adhesive layer 32Ab situated in the middle. As a matter of course, the first release agent layer 41 is applied to the other parts than the top first adhesive layer 31Aa and the bottom first adhesive layer 31Ab, and the second release agent layer 42 is applied to the other parts than the top second adhesive layer 32Aa and the middle second adhesive layer 32Ab.

Figure 2B:
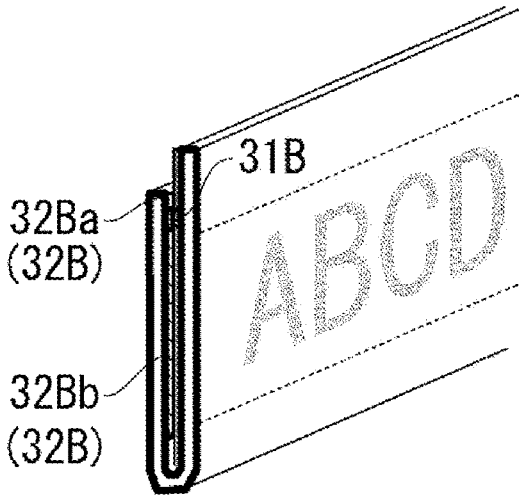
FIG. 2B is a perspective view of a second modification.

In a second modification shown in FIG. 2B, a first adhesive layer 31B of the print portion 22 is applied to the part corresponding to the bottom end part of the top margin 26*a*. A second adhesive layer 32B of the non-print portion 23 includes a sub second adhesive layer 32Ba applied to the width end part, and a main second adhesive layer 32Bb applied to the entire area except the part corresponding to the sub second adhesive layer 32Ba and the first adhesive layer 31B.

Figure 2C:
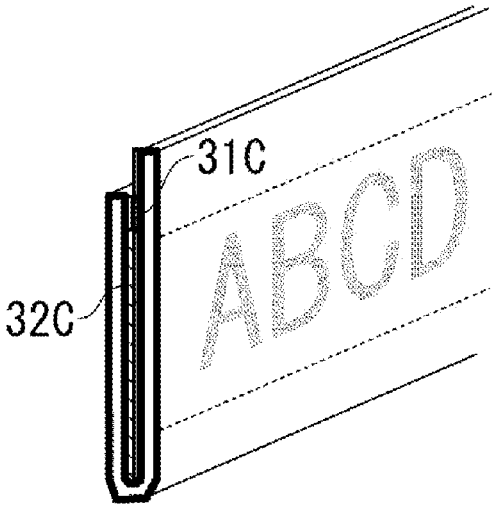
FIG. 2C is a perspective view of a third modification.

In a third modification shown in FIG. 2C, a first adhesive layer 31C of the print portion 22 is applied to the similar part to the first adhesive layer 31B in the second modification. A second adhesive layer 32C of the non-print portion 23 is applied to the similar part to the main second adhesive layer 32Bb in the second modification.

Figure 2D:
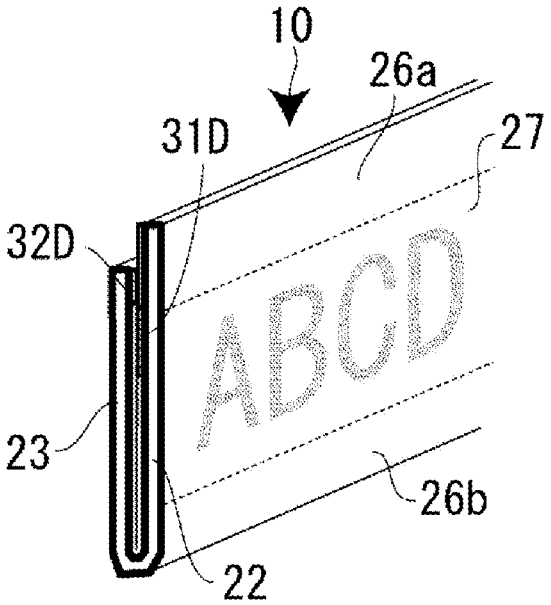
FIG. 2D is a perspective view of a fourth modification.

In a fourth modification shown in FIG. 2D, a first adhesive layer 31D of the print portion 22 is applied to the similar part to the first adhesive layer 31Aa in the first modification. A second adhesive layer 32D of the non-print portion 23 is applied to the similar part to the sub second adhesive layer 32Ba in the second modification.

Figure 2E:
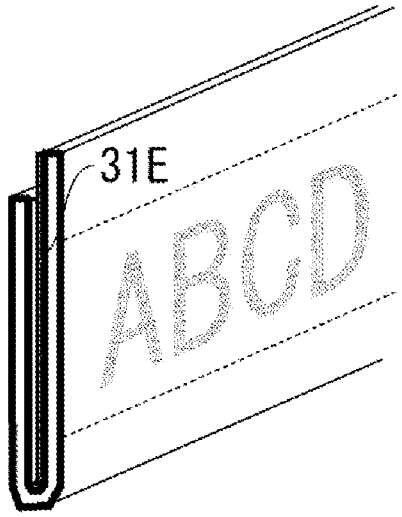
FIG. 2E is a perspective view of a fifth modification.

In a fifth modification shown in FIG. 2E, the second adhesive layer 32 and the first release agent layer 41 are not provided, and a first adhesive layer 31E is applied to the entire area of the print portion 22.

Figure 2F:
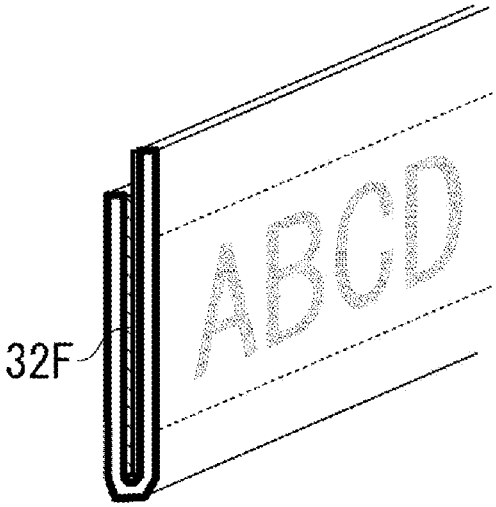
FIG. 2F is a perspective view of a sixth modification.

In a sixth modification shown in FIG. 2F, as opposed to the fifth modification, the first adhesive layer 31 and the second release agent layer 42 are not provided, and a second adhesive layer 32F is applied to the entire area of the non-print portion 23.

Figure 2G:
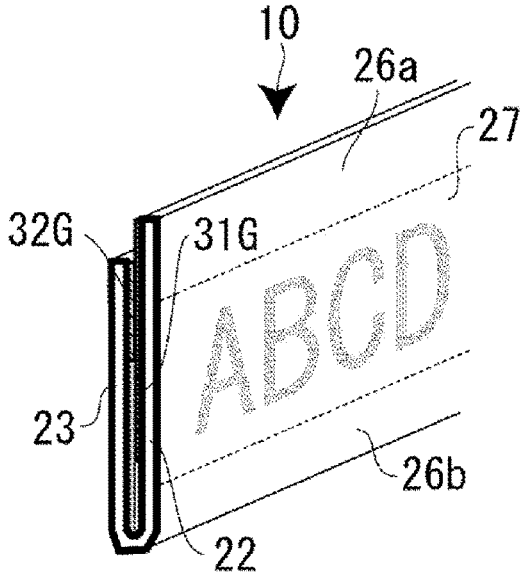
FIG. 2G is a perspective view of a seventh modification.

In a seventh modification shown in FIG. 2G, a first adhesive layer 31G of the print portion 22 is applied to the part corresponding to the middle part of the actual print area 27. A second adhesive layer 32G of the non-print portion 23 is applied substantially to the top half part on the side of the width end part.

Figure 2H:
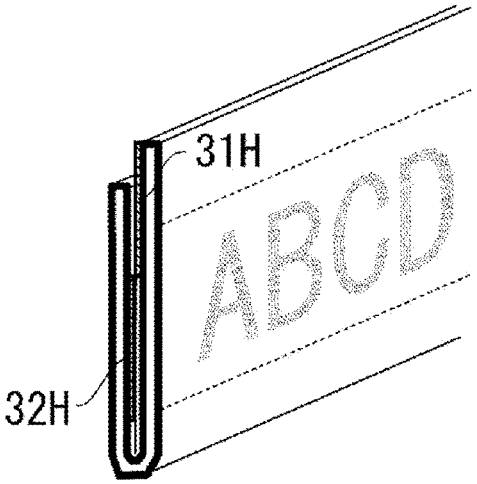
FIG. 2H is a perspective view of an eighth modification.

In an eighth modification shown in FIG. 2H, as opposed to the seventh modification, a first adhesive layer 31H of the print portion 22 is applied substantially to the top half part on the side of the width end part. A second adhesive layer 32H of the non-print portion 23 is applied substantially to the bottom half part on the side of the fold end.

Figure 2I:
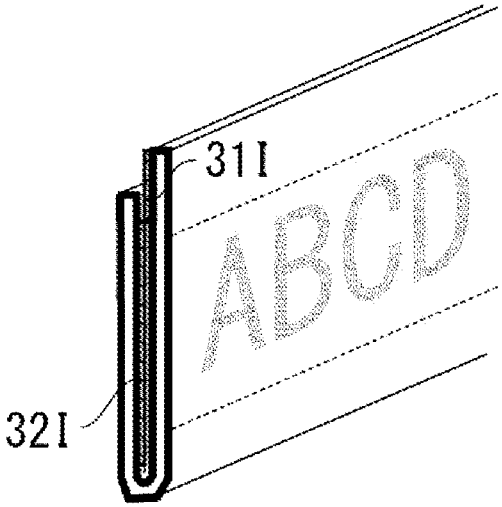
FIG. 2I is a perspective view of a ninth modification.

In a ninth modification shown in FIG. 2I, a first adhesive layer 31I of the print portion 22 is applied to the part corresponding to the top margin. A second adhesive layer 32I of the non-print portion 23 is applied to the entire area except the width end part.

Print Tape of Second Embodiment

Next, a print tape 10A according to a second embodiment will be described with reference to FIG. 3. In the second embodiment, different parts from the first embodiment will be mainly described.

Figure 3:
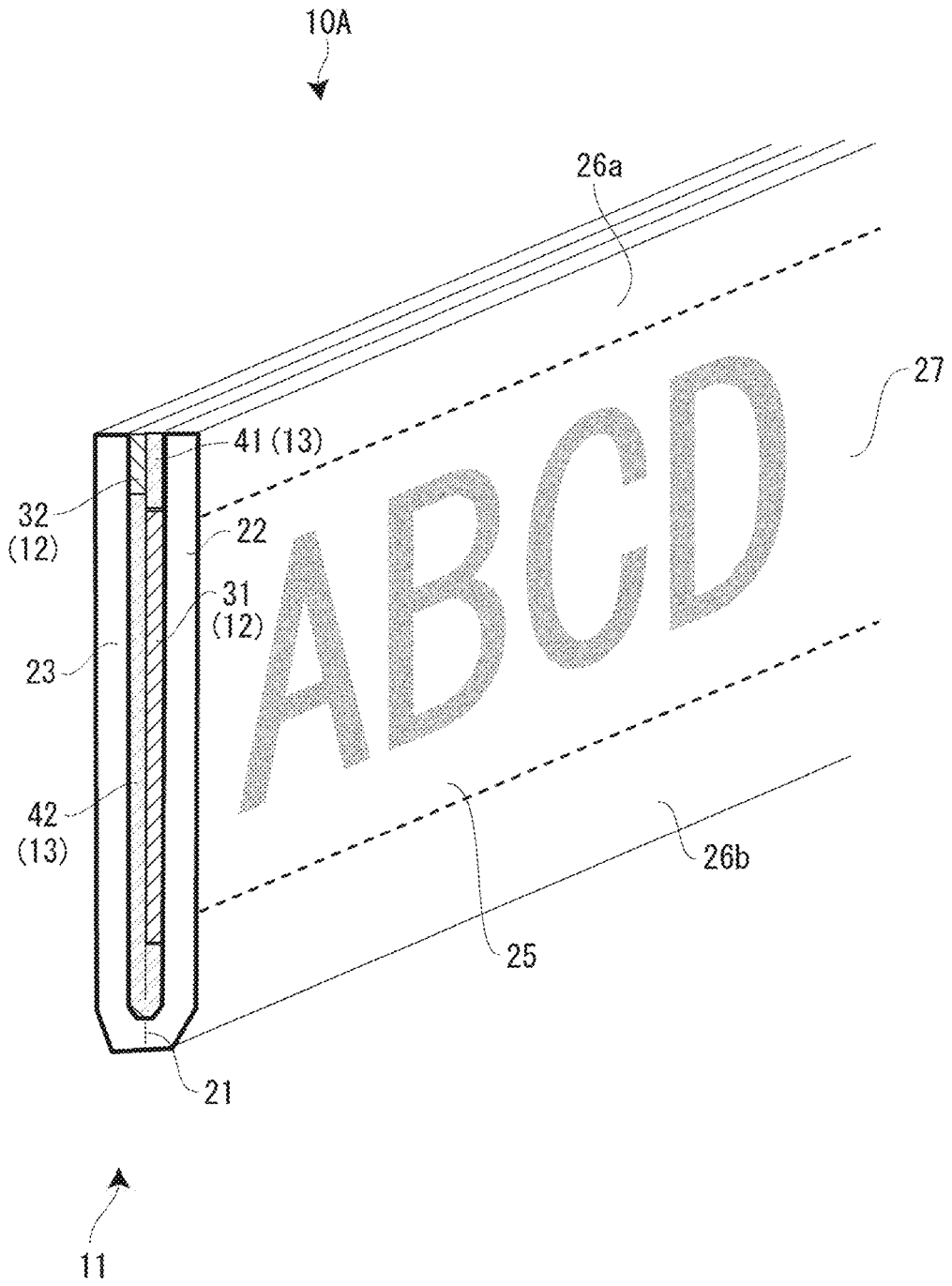
FIG. 3 is a perspective view of a print tape (tape-like member) according to a second embodiment.
Figure 4A:
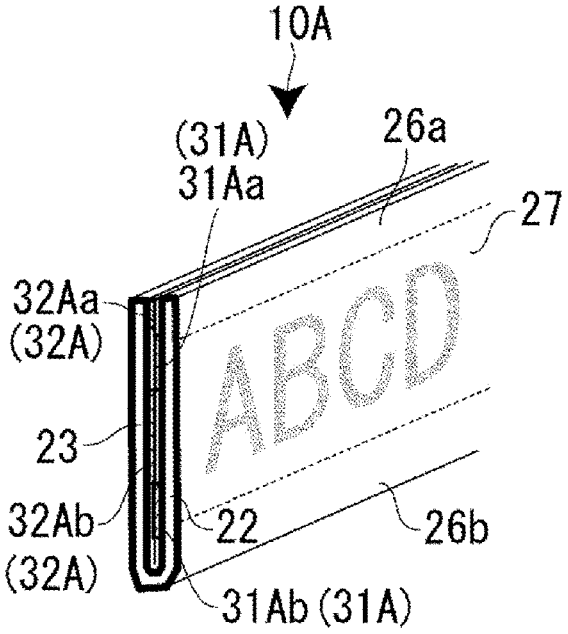
FIG. 4A is a perspective view of a first modification of the print tape according to the second embodiment.
Figure 4B:
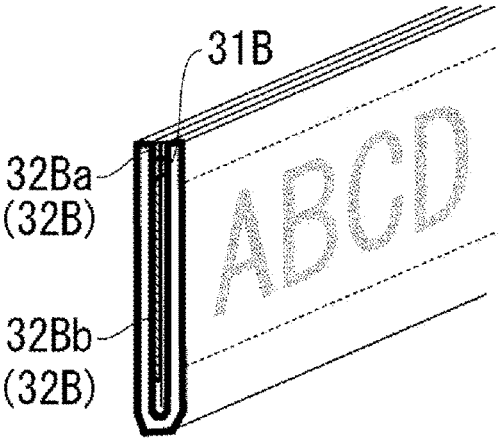
FIG. 4B is a perspective view of a second modification.
Figure 4C:
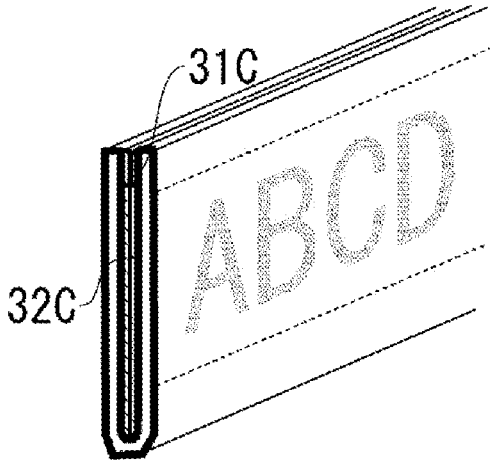
FIG. 4C is a perspective view of a third modification.
Figure 4D:
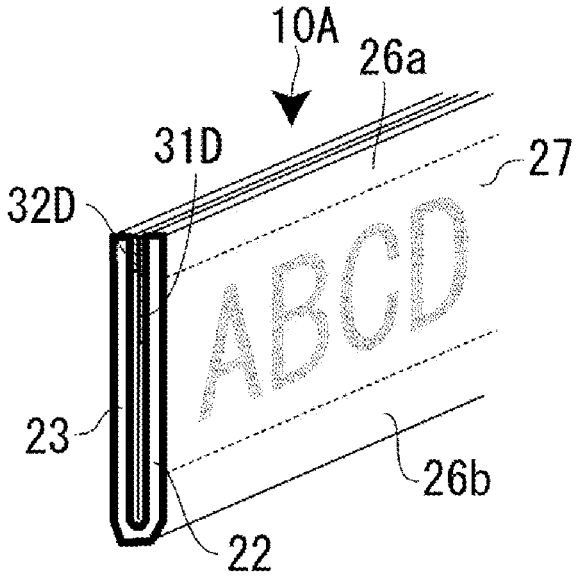
FIG. 4D is a perspective view of a fourth modification.
Figure 4E:
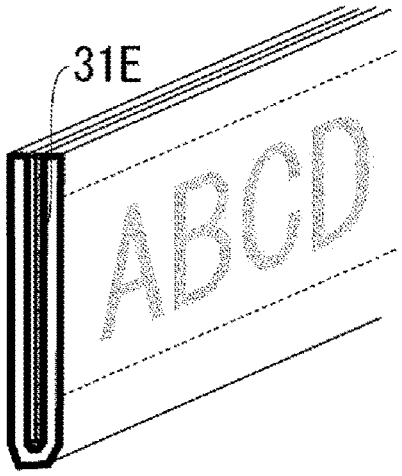
FIG. 4E is a perspective view of a fifth modification.
Figure 4F:
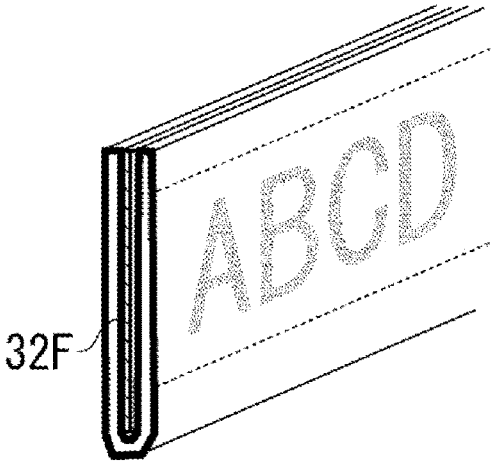
FIG. 4F is a perspective view of a sixth modification.
Figure 4G:
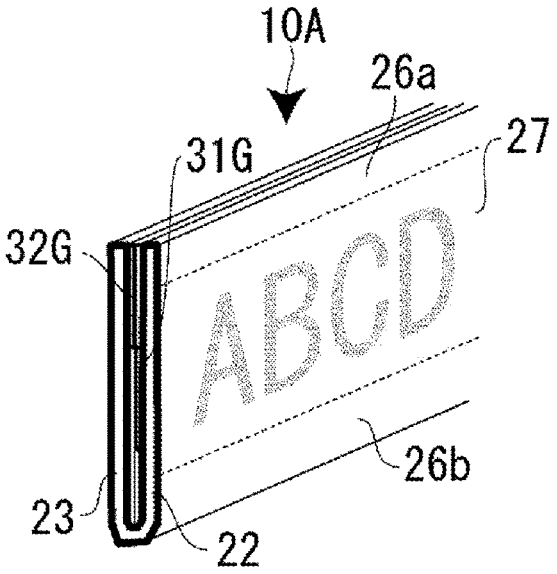
FIG. 4G is a perspective view of a seventh modification.
Figure 4H:
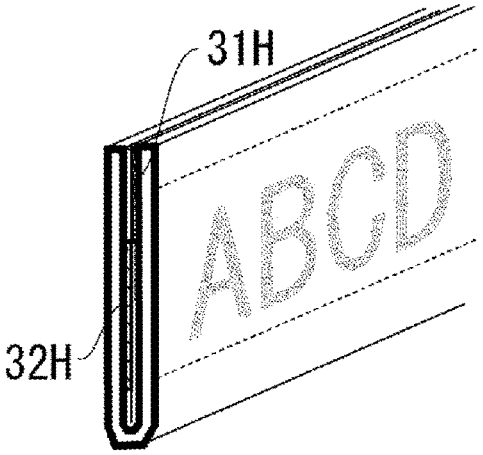
FIG. 4H is a perspective view of an eighth modification.
Figure 4I:
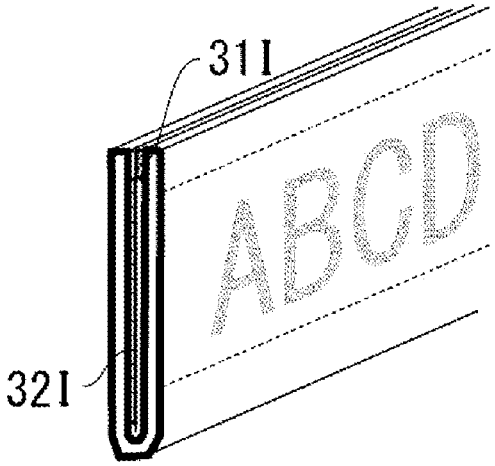
FIG. 4I is a perspective view of a ninth modification.

As shown in FIG. 3, in this embodiment, too, the print tape 10A includes a two-fold tape main body 11, an adhesive layer 12 applied on the inner side of the tape main body 11, and a release agent layer 13 applied to the other parts than the adhesive layer 12.

The tape main body 11 has a print portion 22 and a non-print portion 23. However, in the tape main body 11 of the second embodiment, the print portion 22 and the non-print portion 23 are formed with the same width. Again, in this case, as in the first embodiment, the adhesive layer 12 includes a first adhesive layer 31 applied on the inner side of the print portion 22, and a second adhesive layer 32 applied on the inner side of the non-print portion 23. The release agent layer 13 includes a first release agent layer 41 applied on the inner side of the print portion 22, and a second release agent layer 42 applied on the inner side of the non-print portion 23.

Print Tapes of Modifications of Second Embodiment

Next, the print tapes 10A according to modifications of the second embodiment will be described with reference to FIGS. 4A to 4I. The modifications of the second embodiment correspond to the modifications of the first embodiment. That is, a first modification shown in FIG. 4A has the same basic configuration as FIG. 2A. A second modification shown in FIG. 4B has the same basic configuration as FIG. 2B. A third modification shown in FIG. 4C has the same basic configuration as FIG. 2C. A fourth modification shown in FIG. 4D has the same basic configuration as FIG. 2D. A fifth modification shown in FIG. 4E has the same basic configuration as FIG. 2E. A sixth modification shown in FIG. 4F has the same basic configuration as FIG. 2F. A seventh modification shown in FIG. 4G has the same basic configuration as FIG. 2G. An eighth modification shown in FIG. 4H has the same basic configuration as FIG. 2H. A ninth modification shown in FIG. 4I has the same basic configuration as FIG. 2I. Therefore, description of these is omitted.

Print Tape of Third Embodiment

Next, a print tape 10B according to a third embodiment will be described with reference to FIG. 5. In the third embodiment, different parts from the first embodiment will be mainly described.

Figure 5:
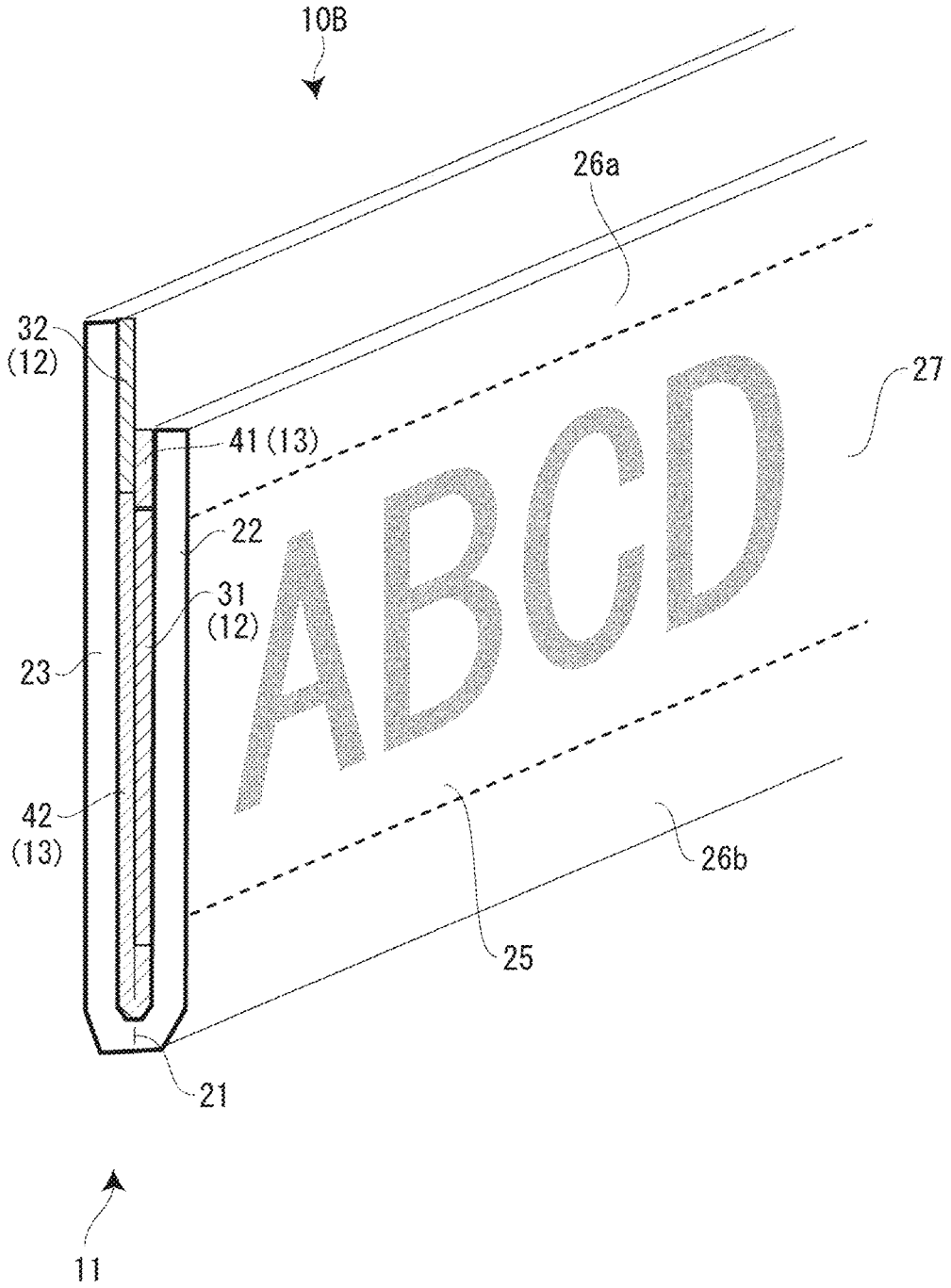
FIG. 5 is a perspective view of a print tape (tape-like member) according to a third embodiment.
Figure 6A:
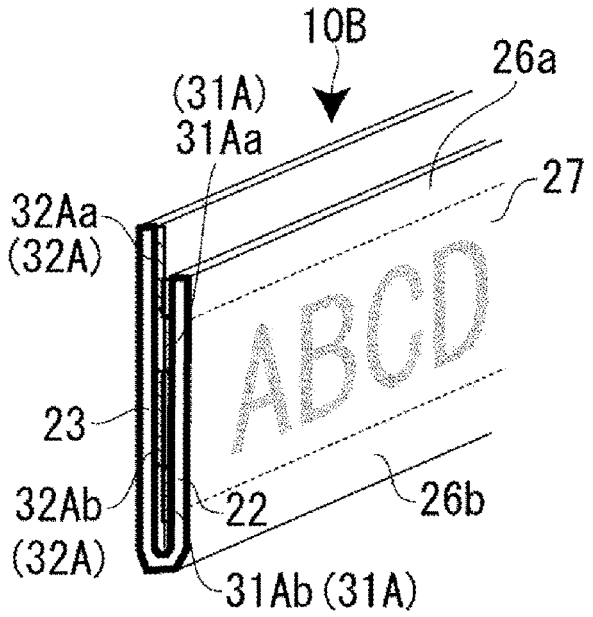
FIG. 6A is a perspective view of a first modification of the print tape according to the third embodiment.
Figure 6B:
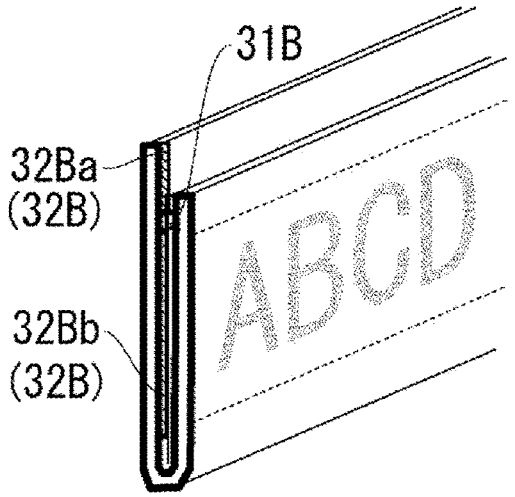
FIG. 6B is a perspective view of a second modification.
Figure 6C:
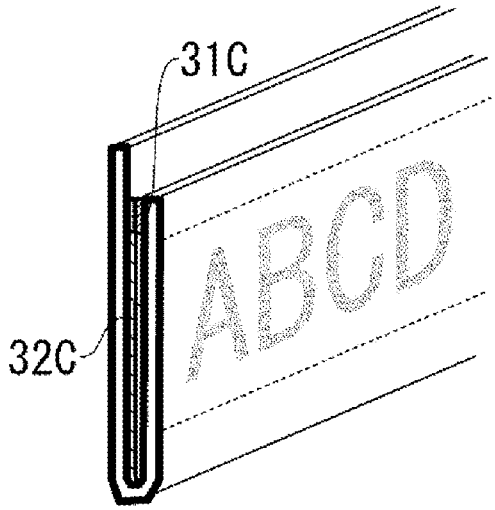
FIG. 6C is a perspective view of a third modification.
Figure 6D:
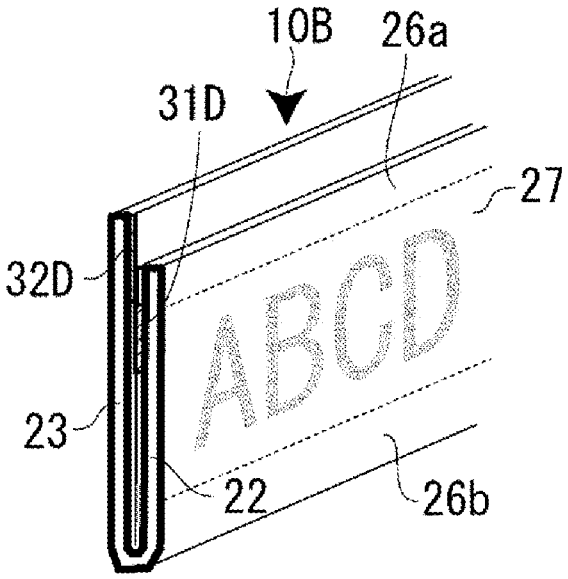
FIG. 6D is a perspective view of a fourth modification.
Figure 6E:
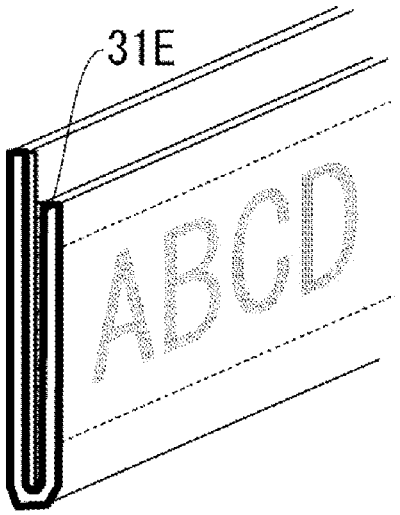
FIG. 6E is a perspective view of a fifth modification.
Figure 6F:
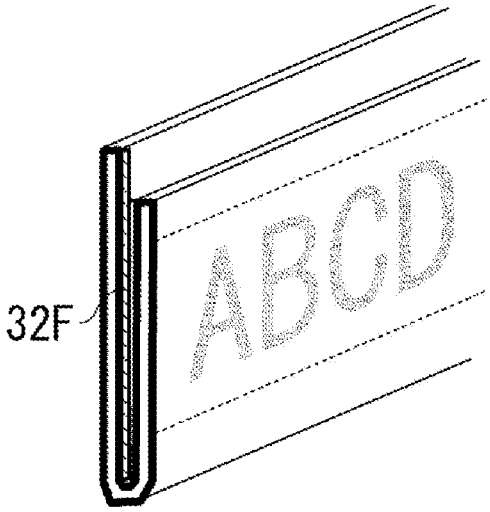
FIG. 6F is a perspective view of a sixth modification.
Figure 6G:
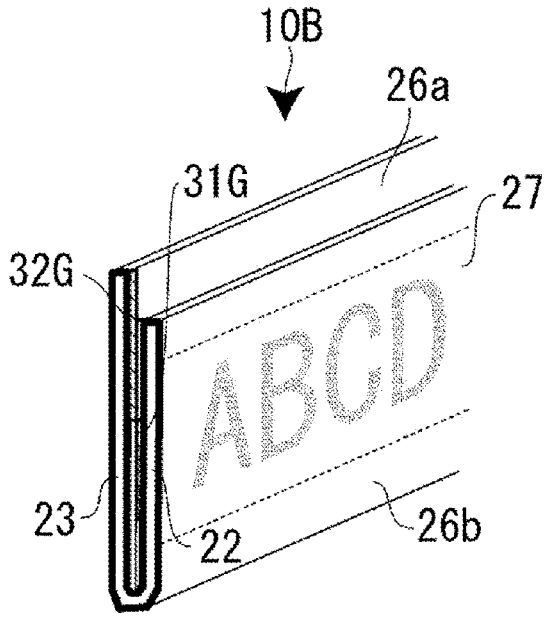
FIG. 6G is a perspective view of a seventh modification.
Figure 6H:
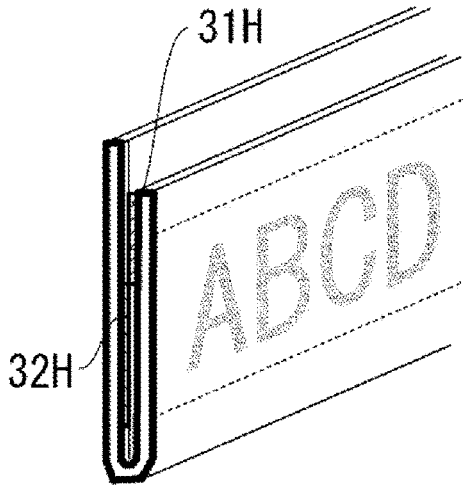
FIG. 6H is a perspective view of an eighth modification.
Figure 6I:
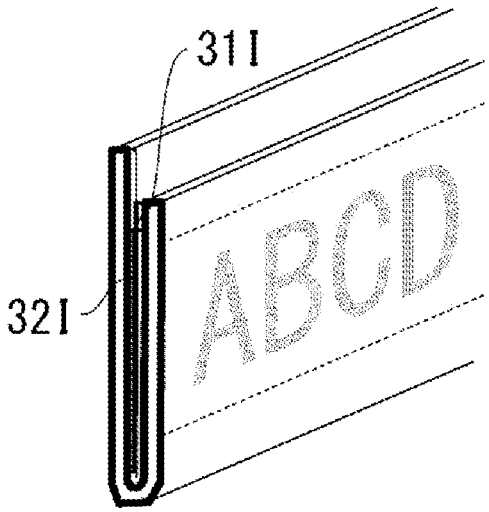
FIG. 6I is a perspective view of a ninth modification.

As shown in FIG. 5, in this embodiment, too, the print tape 10B includes a two-fold tape main body 11, an adhesive layer 12 applied on the inner side of the tape main body 11, and a release agent layer 13 applied to the other parts than the adhesive layer 12.

The tape main body 11 has a print portion 22 and a non-print portion 23. However, in the tape main body 11 of the third embodiment, the print portion 22 is formed to be narrower than the non-print portion 23. That is, the width end part of the non-print portion 23 protrudes with respect to the print portion 22, and this width end part forms a finger hook 23*a*. Again, in this case, as in the first embodiment, the adhesive layer 12 includes a first adhesive layer 31 applied on the inner side of the print portion 22, and a second adhesive layer 32 applied on the inner side of the non-print portion 23. The release agent layer 13 includes a first release agent layer 41 applied on the inner side of the print portion 22, and a second release agent layer 42 applied on the inner side of the non-print portion 23.

Print Tapes of Modification of Third Embodiment

Next, the print tapes 10B according to modifications of the third embodiment will be described with reference to FIGS. 6A to 6I. The modifications of the third embodiment correspond to the modifications of the first embodiment. That is, a first modification shown in FIG. 6A has the same basic configuration as FIG. 2A. A second modification shown in FIG. 6B has the same basic configuration as FIG. 2B. A third modification shown in FIG. 6C has the same basic configuration as FIG. 2C. A fourth modification shown in FIG. 6D has the same basic configuration as FIG. 2D. A fifth modification shown in FIG. 6E has the same basic configuration as FIG. 2E. A sixth modification shown in FIG. 6F has the same basic configuration as FIG. 2F. A seventh modification shown in FIG. 6G has the same basic configuration as FIG. 2G. An eighth modification shown in FIG. 6H has the same basic configuration as FIG. 2H. A ninth modification shown in FIG. 6I has the same basic configuration as FIG. 2I. Therefore, description of these is omitted.

As described above, according to the print tapes 10, 10A, 10B of the embodiments, in the state of the identification label R, the first adhesive layer 31 functions as the pasting start part with respect to the pasting target (cable S) and the second adhesive layer 32 functions as the pasting end part. Therefore, the identification label R can be successfully pasted on the pasting target. Also, since the second release agent layer 42 and the first release agent layer 41 are provided corresponding to the first adhesive layer 31 and the second adhesive layer 32, the print portion 22 and the non-print portion 23 in the two-fold state can be easily strip off and unfolded.

Moreover, since the print tapes 10, 10A, 10B are in a stable two-fold state via the first adhesive layer 31 and the second adhesive layer 32, there is no need to stack a release sheet (release tape) and generation of waste (release sheet) can be prevented effectively. Also, though the print tapes 10, 10A, 10B are wide in the unfolded state, the print tapes 10, 10A, 10B of the two-fold configuration can be installed in thin tape cartridges 70, 70A as described later and desired printing can be performed thereon by a tape printing device 100.

In each of the embodiments, the tape main body 11 may be folded in a plurality of parts, such as two-fold, three-fold, or four-fold. In such cases, the print surface is formed on the outer surface of a tape piece situated at the outermost position, of the plurality of folded tape pieces. Also, (a plurality of) adhesive layers for pasting the neighboring tape pieces together, and release agent layers corresponding to the adhesive layers are provided. However, in the tape main body 11, when unfolded, it is preferable that the print surface comes on the face side and that the adhesive layer comes on the back side.

Tape Cartridge of First Embodiment

Next, a tape cartridge 70 equipped with the print tape 10 (10A, 10B) will be described.

Figure 7:
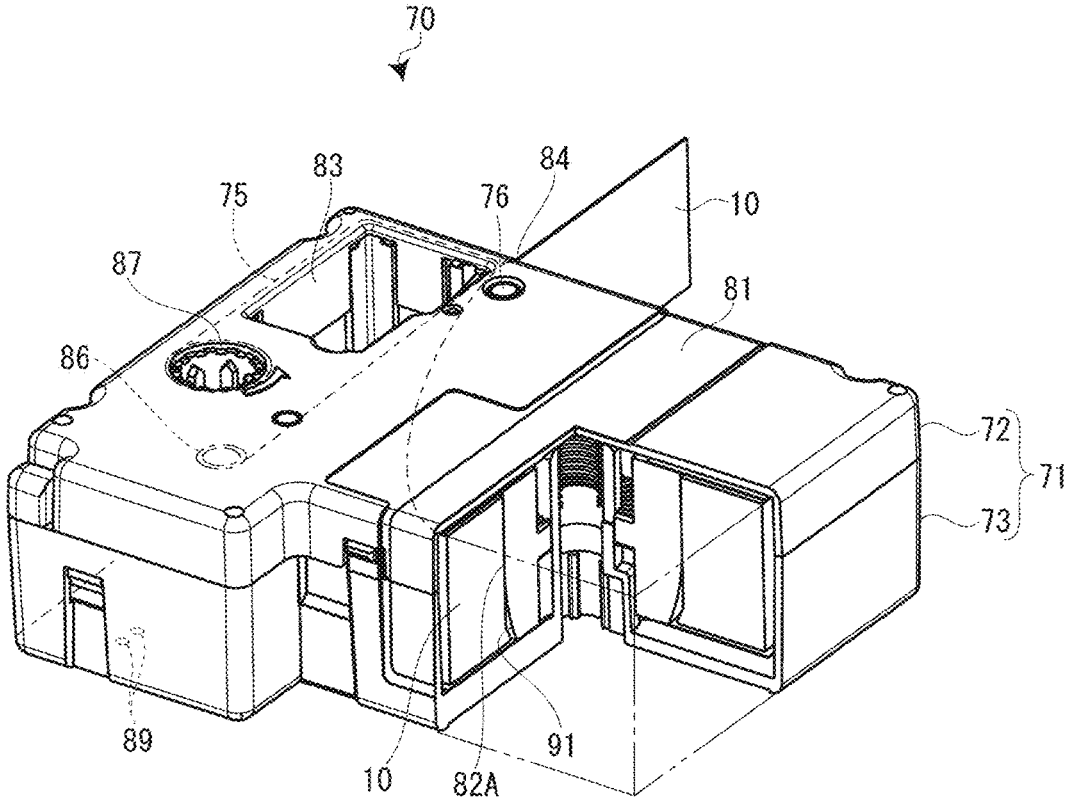
FIG. 7 is a partly cut perspective view of a tape cartridge according to the first embodiment.

FIG. 7 is a partly cut perspective view of the tape cartridge 70 according to the first embodiment. As shown in FIG. 7, the tape cartridge 70 has a cartridge case 71 including a top case 72 and a bottom case 73, and also has the print tape 10, an ink ribbon 75 and a platen roller 76 accommodated in the cartridge case 71.

The top case 72 and the bottom case 73 are resin-molded products having the same "L"-shaped contour. The top case 72 is made of a transparent resin (transparent to visible rays) so that the inside of the cartridge case 71 is visible from the front of the top case 72. An indication label 81 showing attribute information of the print tape 10 in the form of letters is pasted on the front of the cartridge case 71. On the indication label 81, for example, the tape width of the print tape 10 is shown as a number, and the type of the print tape 10 is shown (printed) as a model number.

On the distal end side of the cartridge case 71, the print tape 10 wound on a tape core 82A is accommodated in the way that allows the print tape 10 to be reeled off. On the left-hand side of the proximal end of the cartridge case 71, a rectangular opening 83 which a print head 110 faces as described later is formed. The platen roller 76 is rotatably provided near the rectangular opening 83. Moreover, on the lateral side of the cartridge case 71 near the platen roller 76, a tape send-out port 84 for the print tape 10 is formed. The print tape 10 on which printing is performed with the print head 110 is sent out through this tape send-out port 84.

On the right-hand side of the proximal part of the cartridge case 71, the ink ribbon 75 is accommodated in the state of being wound on a reel-off core 86 and a take-up core 87. The ink ribbon 75 reeled off from the reel-off core 86 travels parallel with the print tape 10, then faces the platen roller 76 and the print head 110, travels around the outer side of the rectangular opening 83, and becomes reeled in on the take-up core 87. Also, on the back side of the cartridge case 71 near the reel-off core 86, a detection target part 89 corresponding to a detection part 125 of a tape printing device 100, described later, is provided (described in detail later). The detection target part 89 forms, for example, a bit pattern based on a plurality of receiving holes and whether these receiving holes are present or absent.

As described above, the print tape 10 of the embodiment has the two-fold configuration in the direction of width. For this reason, the part of the fold 21 on the print tape 10 is thicker than the other parts. Therefore, when the print tape 10 is wound on the tape core 82A, the side of the fold 21 is wound with a greater diameter. Thus, in this embodiment, the lower side (part where the side of the fold 21 is wound) of the cylindrical tape core 82A is formed in a constricted shape with a circular arc-shaped cross section. That is, in the tape core 82A, an end winding site 91 on the side of the fold 21 on the print tape 10 is formed in a constricted shape with a circular arc-like cross section with respect to the other winding sites. Thus, the print tape 10 is wound parallel to the tape core 82A.

Tape Cartridge of Second Embodiment

Figure 8:
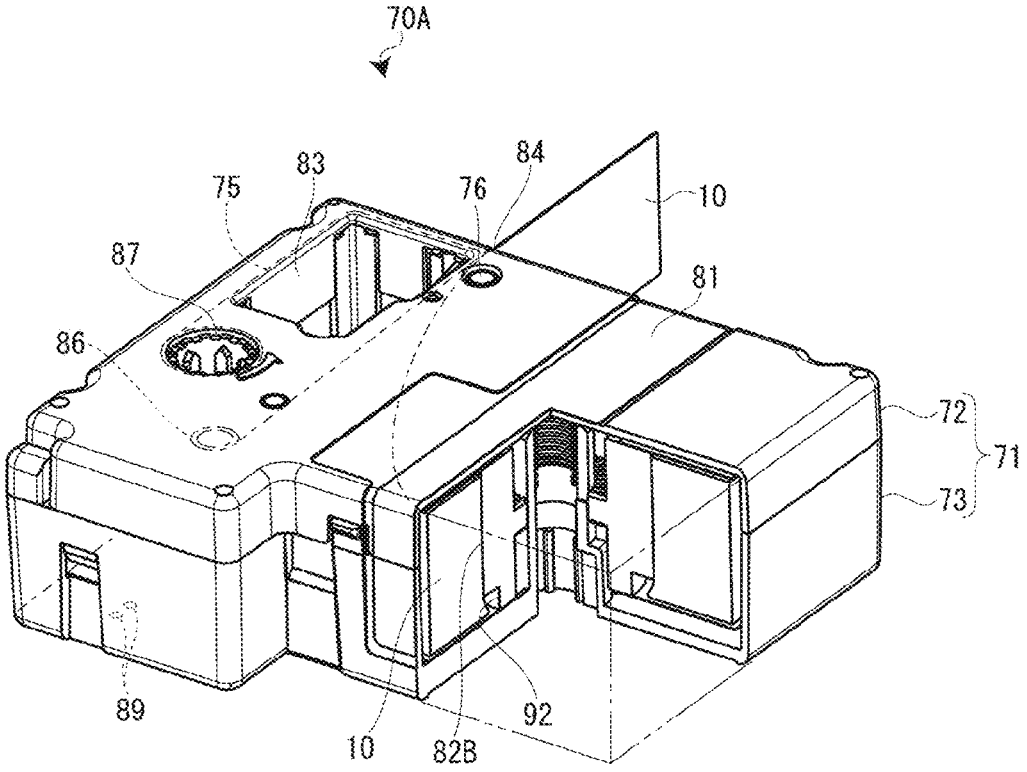
FIG. 8 is a partly cut perspective view of a tape cartridge according to the second embodiment.

Next, a tape cartridge 70A according to the second embodiment will be described with reference to FIG. 8. In the second embodiment, different parts from the first embodiment will be mainly described. This tape cartridge 70A, too, is equipped with the print tape 10 (10A, 10B). Only a tape core 82B has a different configuration from the first embodiment.

The tape core 82B of the second embodiment is formed in a cylindrical stepped form. That is, in the tape core 82B, an end winding site 92 on the side of the fold 21 on the print tape 10 is formed in a stepped form with a smaller diameter than the other winding sites. In this case, too, the print tape 10 is wound parallel to the tape core 82B.

As described above, according to the tape cartridges 70, 70A of the embodiments, the end winding sites 91, 92 of the tape cores 82A, 82B have the special shapes, considering that the part of the fold 21 on the print tape 10 is thick. Therefore, the part of the fold 21 on the print tape 10 wound on the tape cores 82A, 82B does not become thick, and a proper tape roll of the print tape 10 that does not cause trouble with reeling off or the like can be formed.

Tape Printing Device

Next, a tape printing device 100 in which the tape cartridge 70 (70A) is used for printing will be described.

Figure 9:
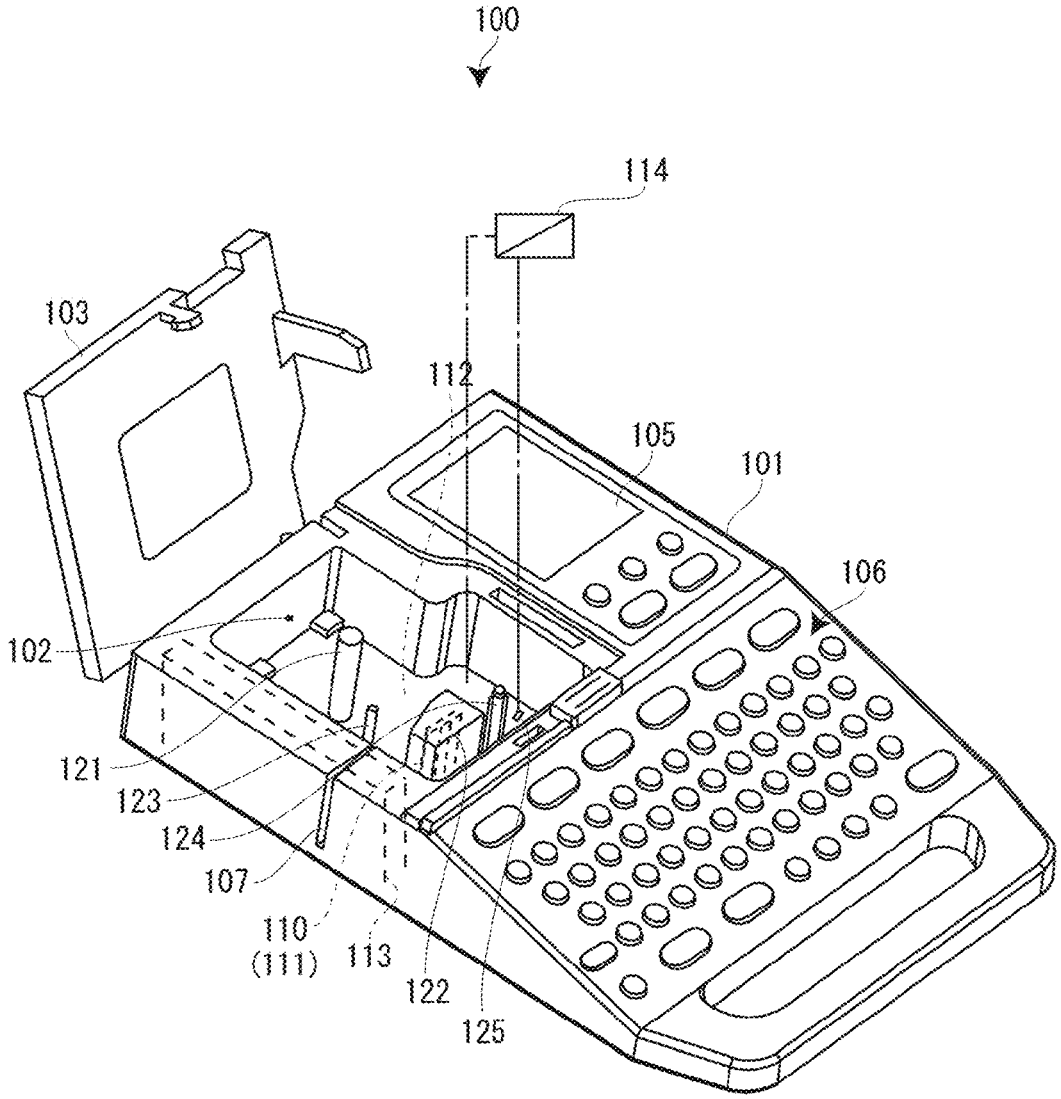
FIG. 9 is an external perspective view of a tape printing device with its cover opened.

FIG. 9 is an external perspective view of the tape printing device 100. As shown in FIG. 9, the tape printing device 100 includes a device case 101 forming an outer shell, a cartridge loading section 102 in which the tape cartridge 70 is loaded removably, and an open/close cover 103 that opens and closes the cartridge loading section 102.

The cartridge loading section 102 and a display 105 are provided to the rear side on the top surface of the device case 101. Also, a keyboard 106 is provided to the front on the top surface of the device case 101. Moreover, a tape discharge port 107 through which the print tape 10 is discharged is provided on a lateral side (left lateral side) of the device case 101.

The tape printing device 100 also has a print mechanism unit 111 with a print head 110 that is provided upright in the cartridge loading section 102, a tape feeding mechanism unit 112 arranged inside the space on the back side of the cartridge loading section 102, a tape cutting mechanism unit 113 arranged inside a portion near the tape discharge port 107, and a control unit 114 (print control unit) that centrally controls these component units.

In the cartridge loading section 102, a positioning protrusion 121 with which the tape core 82A is positioned, the print head 110 (thermal head) covered by a head cover 122, a platen drive shaft 123 which rotationally drives the platen roller 76, and a take-up drive shaft 124 which rotationally drives the take-up core 87 are provided upright. Also, the detection part 125 which detects attribute information of the print tape 10 is provided near the take-up shaft 124. The tape feeding mechanism unit 112 is power-branched by gear train (not shown) and synchronously rotates the platen drive shaft 123 and the take-up drive shaft 124.

The detection part 125 is made up of a plurality of micro switches. The detection part 125 selectively engages with the detection target part 89 (receiving holes) of the tape cartridge 70 and detects the attribute information (tape width and tape type) of the print tape 10. On the basis of the result of the detection, the control unit 114 controls the driving of the print head 110 and the tape feeding mechanism unit 112 (described in detail later).

As the tape cartridge 70 is loaded in the cartridge loading section 102, the tape core 82A engages with the positioning protrusion 121, and the platen roller 76 engages with the platen drive shaft 123. Moreover, the take-up core 87 engages with the take-up drive shaft 124. Then, as the open/close cover 103 is closed, the print head 110 turns and abuts against the platen roller 76 with the print tape 10 and the ink ribbon 75 situated in-between. The tape printing device 100 thus enters a print standby state.

The user inputs desired print information via the keyboard 106, checks the print information on the display 105, and then commands printing by operating keys. As printing is commanded, the control unit 114 drives the tape feeding mechanism unit 112 so as to cause the print tape 10 and the ink ribbon 75 to travel parallel with each other, and also drives the print mechanism unit 111 (print head 110), thus executing printing based on thermal transfer. By this printing and feeding, the print tape 10 is discharged through the tape discharge port 107. On completion of the printing, the control unit 114 drives the tape cutting mechanism unit 113 to cut out the printed part of the print tape 10.

The control unit 114 also sets the actual print area 27 on the print tape 10 on the basis of the attribute information of the print tape 10 inputted from the detection part 125. Also, considering the purpose of use of the print tape 10 of this embodiment, the control unit 114 controls, for example, the print head 110 and the tape feeding mechanism unit 112 to carry out high-density printing. Desired printing is carried out on the print tape 10 and the identification label R is thus prepared.

Configuration of and Method of Using Identification Label

Figure 10A:
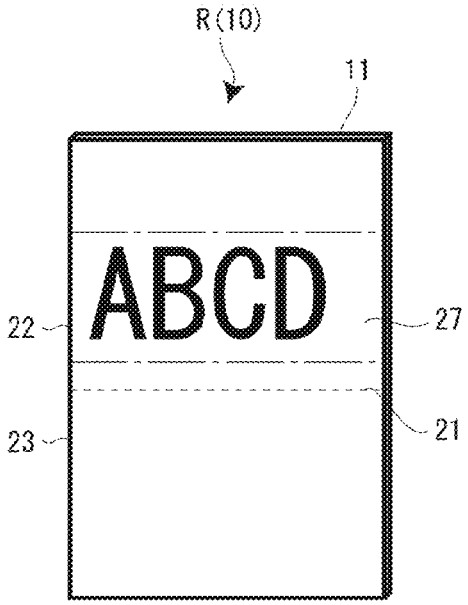
FIGS. 10A and 10B show the front and back of the state where a prepared identification label is unfolded.
Figure 10B:
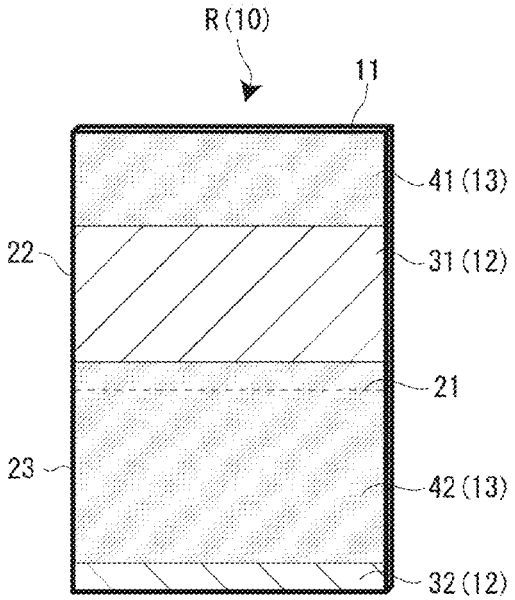

FIGS. 10A and 10B show the state where the prepared identification label R is unfolded, that is, the state where the print portion 22 and the non-print portion 23 are stripped off from each other and unfolded.

As shown in the front side view of FIG. 10A, an indication "ABCD" for identification is printed laterally in the actual print area 27 on the front side of the identification label R.

Meanwhile, as shown in the back side view of FIG. 10B, on the back side of the identification label R, the first adhesive layer 31 is arranged transversely in the part corresponding to the actual print area 27, and the second adhesive layer 32 is arranged transversely at the bottom end part. Also, the release agent layer 13 (first release agent layer 41 and second release agent layer 42) is arranged in the other parts than the first adhesive layer 31 and the second adhesive layer 32.

Next, the procedure of pasting the identification label R on the cable S will be described briefly with reference to FIGS. 11A to 11D. First, in the prepared identification label R, the print portion 22 and the non-print portion 23 are stripped off from each other (unfolded), using the finger hook 22*a*. Next, the first adhesive layer 31 is pasted on the cable S in such a way that the indication "ABCD" or the first adhesive layer 31 becomes parallel to the cable S (see FIG. 11A). Next, the identification label R is wound on the cable S, using the first adhesive layer 31 as a reference point (see FIG. 11B).

Figure 11A:
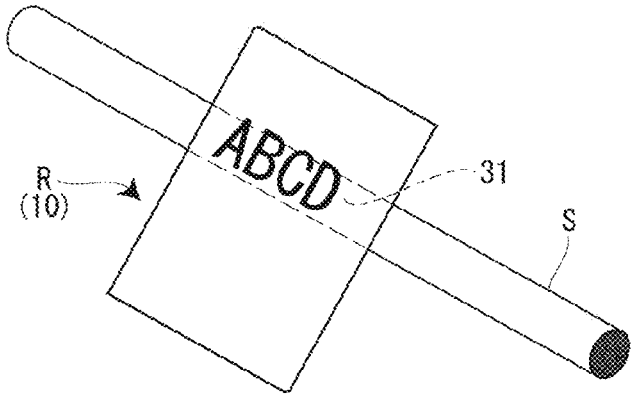
FIGS. 11A to 11D are explanatory views showing the procedure of pasting an identification label onto a cable.
Figure 11B:
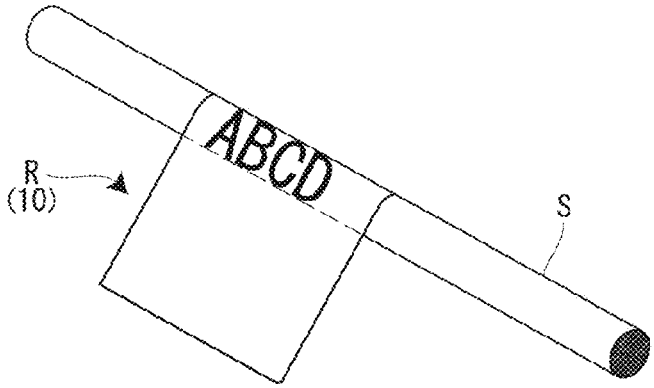
Figure 11C:
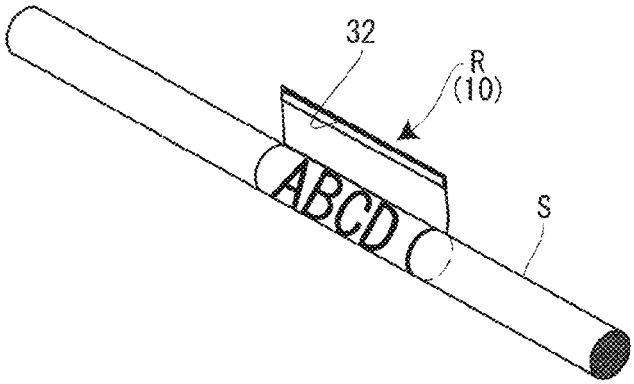
Figure 11D:
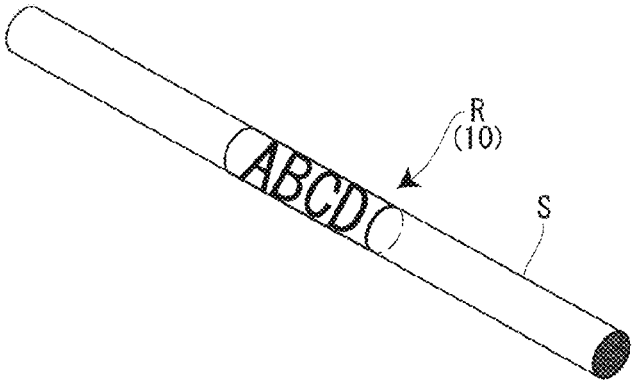

The identification label R is made to circle around the cable S once and is wound further over the indication "ABCD" (see FIG. 11C). Finally, the second adhesive layer 32 is pasted on the identification label R wound on the cable S in such a way as to fasten the identification label R (see FIG. 11D). Thus, the identification label R is wound on the cable S and the indication "ABCD" is laminated.

What is claimed is:

1. A tape member having a length direction and a width direction, the tape member comprising:

a folded tape main body that was formed by folding a tape main body in two along the length of the tape member, the folded tape main body having a print portion on a first side of the fold and a non-print portion on a second side of the fold, wherein the folded tape main body further includes an adhesive layer that pastes the print portion and the non-print portion together, an outermost surface of the print portion forms a print surface and the adhesive layer is provided on an inner surface of the print portion that is opposite from the print surface, a first release agent layer is provided abutting the adhesive layer on a part of the inner surface of the print portion on which the adhesive layer is not provided such that the first release agent layer and the adhesive layer form a plane on the inner surface of the print portion, and a second release agent layer is provided on an inner surface of the non-print portion such that the second release agent layer contacts the adhesive layer and the first release agent layer.

2. A tape member having a length direction and a width direction, the tape member comprising:

a folded tape main body that was formed by folding a tape main body in two along the length of the tape member, the folded tape main body having a print portion on a first side of the fold and a non-print portion on a second side of the fold, wherein the print portion has an outermost surface that forms a print surface and a surface of the print portion that is opposite from the print surface that forms an inner surface of the print portion, the non-print portion has an outermost surface and a surface of the non-print portion that is opposite from the outermost surface of the non-print portion that forms an inner surface of the non-print portion, the folded tape main body further comprises a first adhesive layer and a second adhesive layer that paste the print portion and the non-print portion together, the first adhesive layer being disposed on the inner surface of the print portion and the second adhesive layer being disposed on the inner surface of the non-print portion, a first release agent layer is provided abutting the first adhesive layer on a part of the inner surface of the print portion on which the first adhesive layer is not provided such that the first release agent layer and the first adhesive layer form a first plane on the inner surface of the print portion, and a second release agent layer is provided abutting the second adhesive layer on a part of the inner surface of the non-print portion on which the second adhesive layer is not provided such that the second release agent layer and the second adhesive layer form a second plane on the inner surface of the non-print portion, and such that the second release agent layer contacts the first release agent layer.

3. The tape member according to claim 2, wherein the first adhesive layer does not contact the second adhesive layer.

4. The tape member according to claim 2, wherein:

the first release agent layer contacts the first adhesive layer; and the second release agent layer contacts the second adhesive layer.

5. The tape member according to claim 2, wherein an actual print area is provided on the print surface of the print portion, the actual print area not including the fold or a side of the print surface opposite from the fold in the width direction, and the first adhesive layer is provided on the inner surface of the print portion that is opposite from the actual print area.

6. The tape member according to claim 2, wherein the second adhesive layer is provided on the inner surface of the non-print portion at a side of the non-print portion that is opposite from the fold in the width direction.

7. The tape member according to claim 2, wherein the print piece is formed to be wider than the non-print piece in the width direction.

8. The tape member according to claim 2, wherein the fold further comprises perforations.

9. The tape member according to claim 2, wherein:

the first release agent layer contacts the second adhesive layer; and the second release agent layer contacts the first adhesive layer.

10. The tape member according to claim 2, wherein an actual print area is provided on the print surface of the print portion, the actual print area not including the fold or a side of the print surface opposite from the fold in the width direction, and the first adhesive layer is provided on the inner surface of the print portion that is opposite from the actual print area such that the first adhesive layer entirely overlaps the actual print area.

* * * * *